United States Patent [19]

Shepherd et al.

[11] Patent Number: 4,561,623

[45] Date of Patent: Dec. 31, 1985

[54] BOOK HOLDER

[75] Inventors: Charles G. Shepherd, Oakville; David Chapman, London, both of Canada

[73] Assignee: The Chas. Chapman Company Limited, London, Canada

[21] Appl. No.: 809,370

[22] Filed: May 11, 1984

[30] Foreign Application Priority Data

May 11, 1983 [CA] Canada ..... 427878

[51] Int. Cl.[4] ..... B42D 3/06; B42D 7/00

[52] U.S. Cl. ..... 248/447; 281/47

[58] Field of Search ..... 248/359 J, 447; 281/45, 281/19 R, 17, 1, 47; 211/57.1, 45; 312/233

[56] References Cited

U.S. PATENT DOCUMENTS

| | | | |
|---|---|---|---|
| 1,942,547 | 1/1934 | Gordon et al. | 281/47 |
| 2,784,522 | 3/1957 | Bergman | 248/447 |
| 3,176,952 | 4/1965 | Gilmore | 281/47 |
| 3,275,279 | 9/1966 | Caldwell et al. | 312/233 X |
| 3,373,749 | 3/1968 | Wance et al. | 281/19 R |
| 3,908,954 | 9/1975 | Nix | 248/447 |
| 3,918,672 | 11/1975 | Torn et al. | 248/447 |
| 4,323,290 | 4/1982 | Hickman et al. | 312/233 X |

*Primary Examiner*—Ramon S. Britts
*Assistant Examiner*—K. J. Chotkowski
*Attorney, Agent, or Firm*—Hirons, Rogers & Scott

[57] ABSTRACT

A telephone book holder is described which consists of a spine with two groups of parallel channels in its rear surface. Edges of front and rear covers are dimensioned to be slid into respective channels of each group, the edges being connected to the covers by living hinges. Book retaining wires are pivotally connected at the top end of the spine and can be press fitted to the other end to retain a telephone book in position. Top and bottom caps are securable to the ends of the spine to retain the covers and the wires on the spine. The covers can be replaced without requiring removal of the book or complete detachment of the end caps and the thickness of the book to be held is adjustable by sliding the covers into appropriate channels.

19 Claims, 5 Drawing Figures

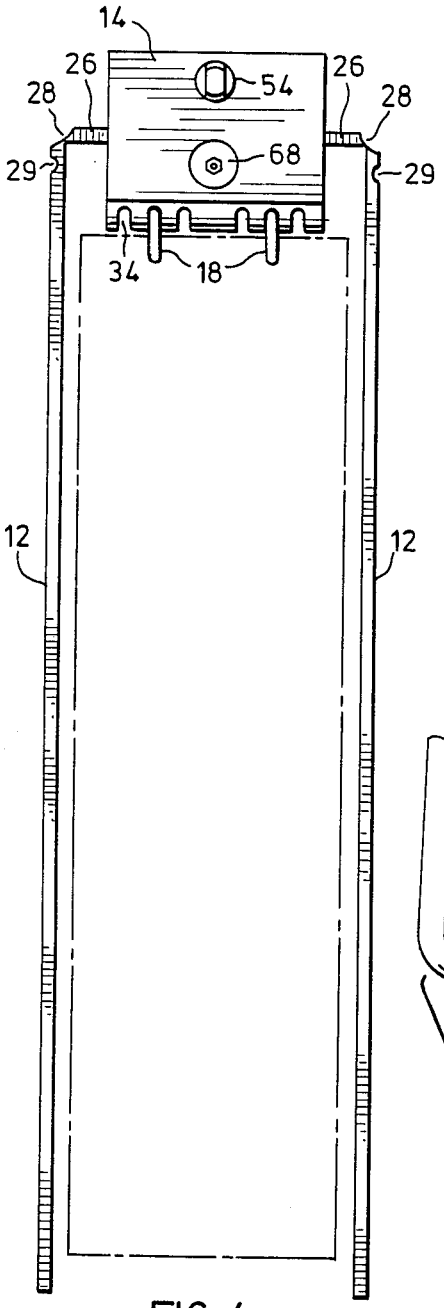
FIG. 4
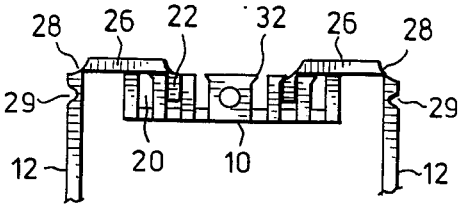
FIG. 5
FIG. 6
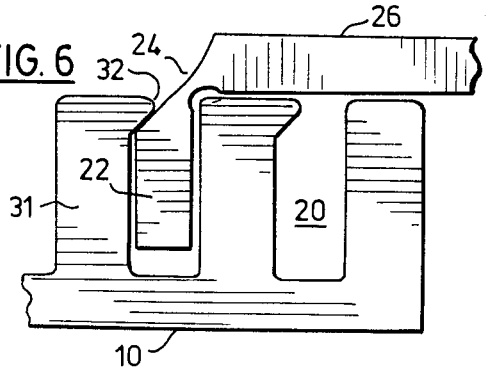
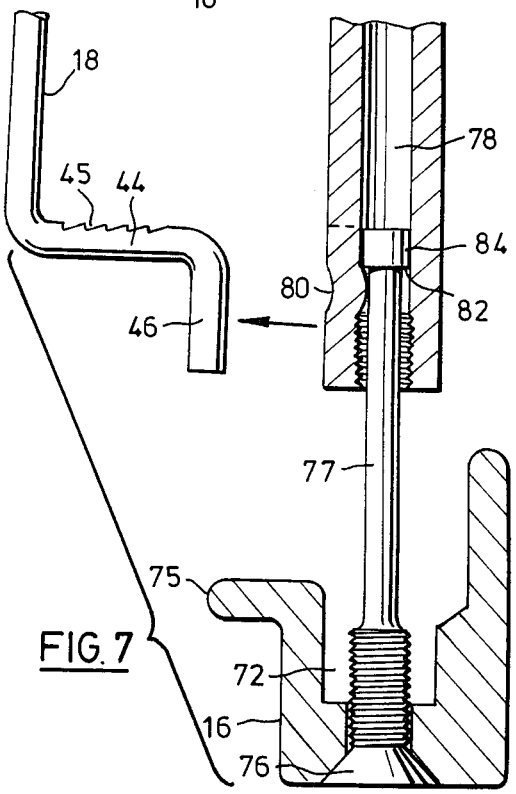
FIG. 7

BOOK HOLDER

The present invention relates to a book holder, and particularly, but not exclusively, to a book holder for telephone books used in public places and the like.

A telephone book holder should satisfy a number of design criteria in addition to basic requirements of being robust, durable and inexpensive. Damaged parts, such as the covers, should be replacable without requiring removal of the telephone book. The covers should also be adjustable in situ to accommodate telephone books of different thicknesses. When a telephone book is being removed or replaced, wires for retaining the book on the holder should be easily adjustable and should not require components of the book holder to be separated or dismantled. Also, the book holder should require a minimal number of tools for assembly and it should be also constructed to minimize dismantling or damage by unauthorized personnel such as vandals.

One existing type of telephone book holder has front and back covers attached to a spine, by hinged cover portions which overlap on the spine. These hinged cover portions have respective sets of apertures such that when overlapped may be aligned to receiving projections located on the inner surface of the spine. Different apertures from each cover can be located on the same pegs to vary the width between the front and rear covers and so accommodate various thicknesses of telephone books. Such covers have to be inserted from the side of the spine and aligning the apertures on the correct pegs is tricky and time-consuming. If a single cover should require replacement, due to vandalism for example, the telephone book must firstly be removed which greatly increases the time and complexity of the procedure reducing the number of book holders that can be repaired in a certain time. The spine has a perpendicular comb fixed to the top and bottom ends separated by the height of the hinged cover portions, and adjacent comb teeth define recesses for receiving respective ends of two book retaining wires, which are then bent around an internally screw-threaded pin mounted parallel to the spine by a bracket.

The only way that a telephone book can be inserted or removed is by unscrewing one of the pins, sliding it out from engagement with the bracket and then rotating the wires outwardly and then removing or inserting the book. This requires separating components from the spine and in some cases more than one telephone book may be accommodated in a single holder and removal of the end pin effectively releases all of the books making replacement of one book more difficult and time-consuming. Also, there is the risk of dropping or losing the component which further adds to the complexity of the procedure. This type of holder is usually mounted in a kiosk or other telephone area, using chains fixed to rigid suspension points on the spine. Such suspension points have been found susceptible to vandalism because, if the book holder is sharply twisted the chain can be broken because it does not accommodate the torsional forces generated. Another disadvantage of this holder is that the end pins can be easily removed with conventional tools such as a square head screwdriver or in some cases a standard Allen key, which also facilitates vandalism.

An object of the present invention is to provide an improved book holder which overcomes the disadvantages associated with such existing book holders.

The present invention provides a book holder in which both the front and rear book covers can be located on a spine in a plurality of different positions without requiring removal of the telephone book, and a telephone book can be replaced by without requiring any parts of the book holder to be dismantled.

In a preferred embodiment of the invention the book holder spine has six longitudinally extending parallel channels on its outer surface. The channels are arranged in groups of three symmetrically located about the centre of the spine. The front and rear covers can be slid from the end of the spine into any one channel of each group of three to define a space to accommodate telephone books of varying thicknesses. The book retaining wires extend between the ends of the spine and can be positioned across the width of the spine. Top and bottom caps fastened to the spine by tamper-proof screws retain the front and rear covers and the retaining wires in place. A cover or telephone book can be removed or replaced by slackening the bottom tamper-proof screw, pulling the bottom cap clear of the spine and then rotating it to allow the covers to be removed and the retaining wires to be rotated about the other end.

When a telephone book is being inserted the free ends of the wires are pivoted inwards and secured to the spine by spring tension to permit an operator to fasten the lower cap with ease.

These and other aspects of the present invention will now be described by way of example with reference to the accompanying drawings in which:

FIG. 4 is a front elevation of an assembled telephone book holder drawn to a larger scale with the end portions partially broken away, and FIG. 5 is a sectional view of FIG. 2 on the line 5—5 of FIG. 4;

Figure 1:
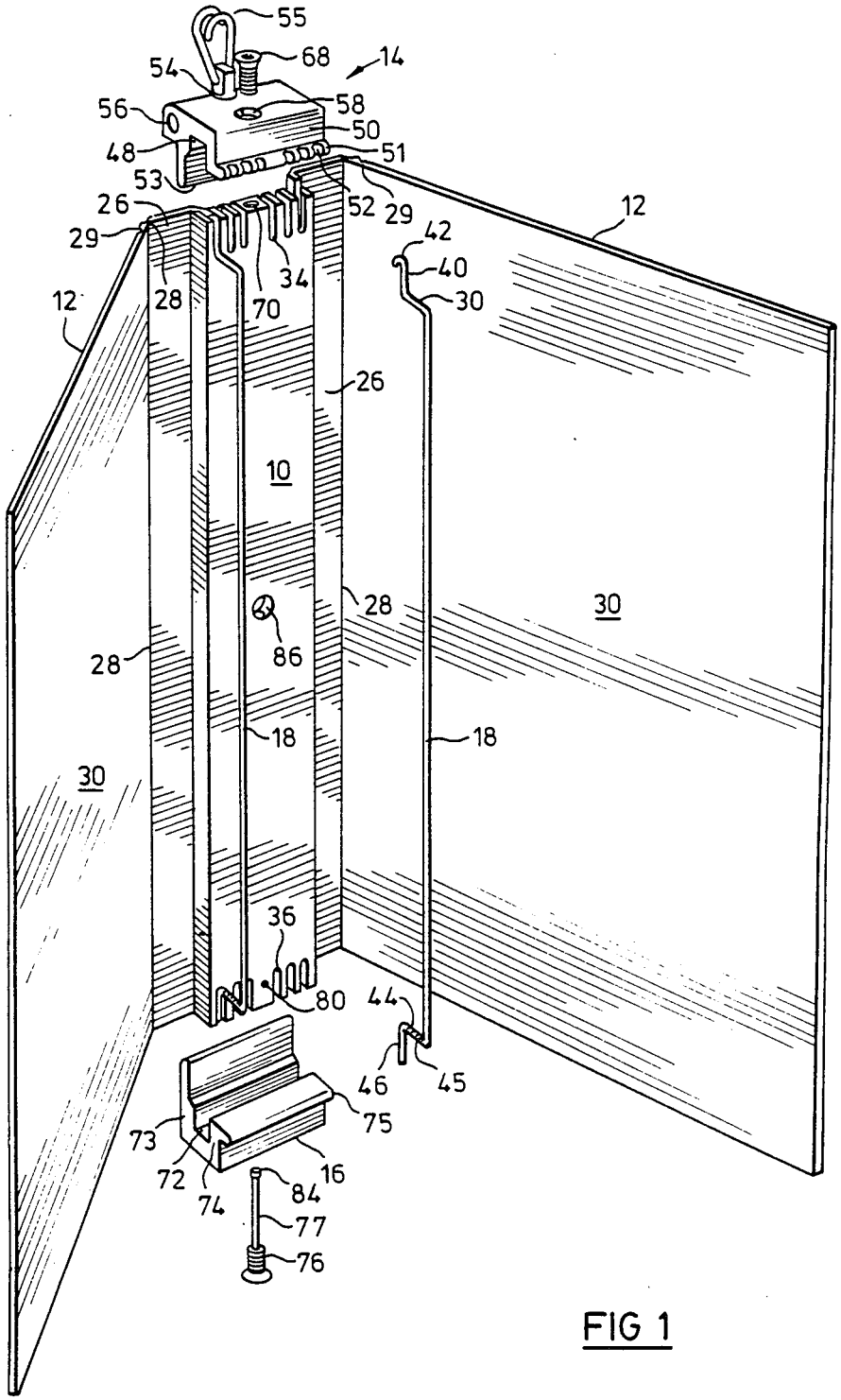
FIG. 1 is a perspective partly exploded front view of a telephone book holder.

Reference is first made to FIG. 1 of the drawings which shows all the parts necessary to assemble a preferred form of the telephone book holder. The telephone book holder consists of: a rectangular planar anodized aluminum spine 10 to which are attached front and rear rectangular covers 12 and 14 respectively made from high density polyethylene; a pair of metal wires 16 for retaining a telephone book (not shown in the interest of clarity), and top and bottom caps, generally indicated by reference numeral 18, 20 which are also made of anodized aluminum and which retain the covers and the wires to the spine as will be explained in detail later.

Figure 2:
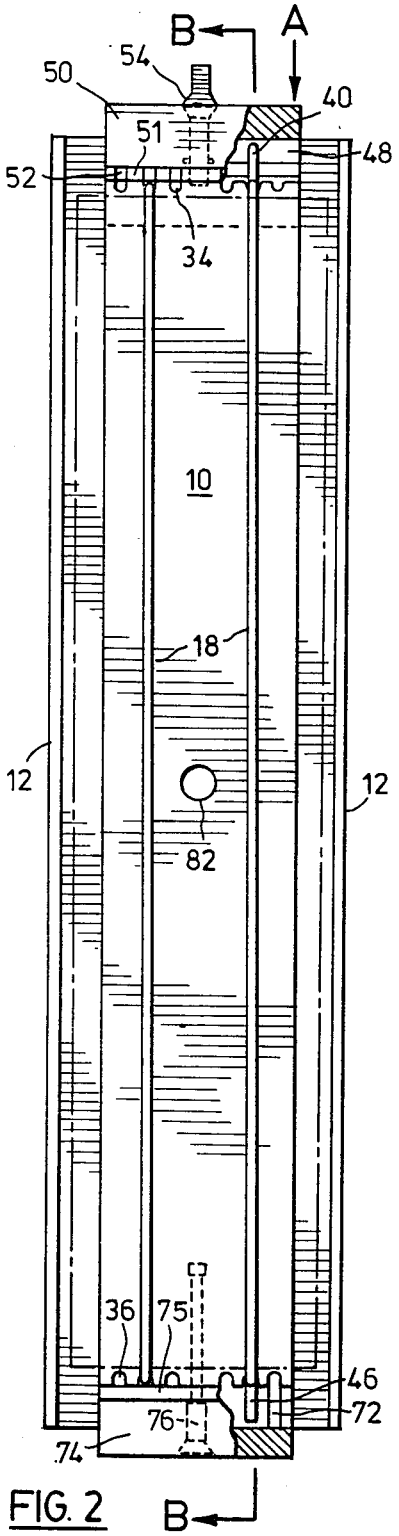
FIG. 2 is a top view of the book holder of FIG. 1 to a larger scale with the cap and guide wires removed and showing how the covers are mounted on the spine.

As seen in FIG. 2 the spine contains six parallel channels 22 (one of which is shown in broken outline) in groups of three, symmetrically arranged on opposite sides of a longitudinal center line of the spine. Each channel 22 is defined by a pair of ribs 24 which run the length of the spine and is adapted to receive an edge 26 of the front or rear cover. The front and rear covers are allochiral and for clarity only the front cover will be described but it will be understood that the same description be applied to the other cover which is also numbered with like numerals. Edge 26 is connected by a living hinge 28 to a rear planar portion 30 which in turn is connected to the front cover by a second and third living hinges 32, 33. The rib defining the innermost surface of each channel has a projection 34 extending into the channel for engaging the rear surface 36 of the living hinge to prevent the edge from being removed and hence retaining the covers in the channels securely, and also forming a substantially watertight seal. The two other living hinges 32 and 33 are provided between the portion 30 and the cover 12 and to permit the angle between the rear planar surfaces 30 and the covers 12, 14 respectively to be made more than 90° easier than if a single living hinge was used. At the top and bottom of the spine channels 22 open into slots 38 which extend through the thickness of the spine for receiving ends of book retaining wires 16 as will be explained.

Each of the wires 16 has a straight elongate portion 40 which is then bent through 90° at the top into a shorter generally perpendicular portion 42 which is again bent through 90° into a shorter portion 44, parallel to the straight portion 40. Portion 44 terminates in a hooked portion 46. The portion 44 is dimensioned to fit into the length of slot 38 with minimal clearance between the hook portion and the end of the spine. The bottom of the straight portion 40 is bent through 90° towards the spine into a shorter straight portion 48 the upper surface 49 of which is serrated for engagement (FIG. 3) with the top of one of slots 38 in the bottom of the spine and the portion 48 is then bent through 90° into shorter straight portion 50 parallel to the straight portion 40.

Portions 50 are dimensioned to fit into a selected slot 38 so that there is minimal clearance between the end of portion 50 and the end of the spine. The distance between the bases 51 of the slots at the top and bottom of the spines is slightly greater than the length of the straight portion 40 so that when the portion 50 is engaged in the slot 38 by serrated surface 49, the straight portion 40 bows towards the spine, and if a book is retained, presses against the book.

The top cap 18 has a front and a longer rear wall 52, 53 respectively defining a recess 54 which is dimensioned to fit over the end of the spine, with the covers and retaining wires in place, and is adapted to be secured to the end of the spine by a tamper-proof screw 55 which engages with a threaded aperture 56 in the center of the spine. The front wall 52 extends across the inner surface of the spine to partly cover slots 38. The wall has an integral perpendicular lip 60 formed with six recesses 62 spaced to match the spacing of the slots 38. The recesses 62 are narrower at the rear than at the front to frictionally receive portion 44 of wires 16 when the wires are rotated outwardly by 90° as will be explained. The wires are retained in this position to facilitate removal and replacement of the telephone books. A swivel hanger pin 64 is mounted on the top surface of the cap and carries a clip 66 for attachment to a chain (not shown in the interest of clarity). The cap also has an aperture 68 which extends from one side of the cap to the other and permits the book holder to be pivotally mounted on a horizontal rod (not shown).

Figure 3:
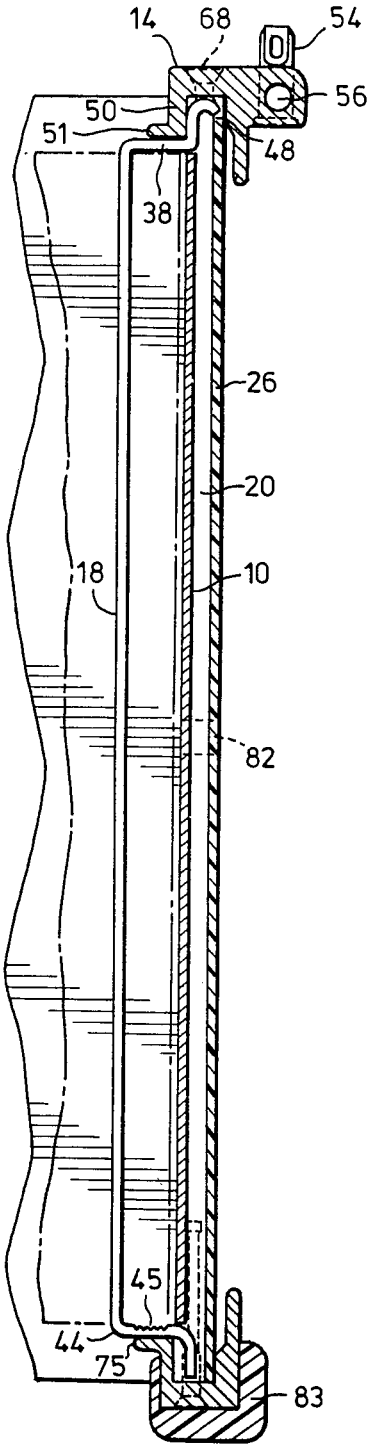
FIG. 3 is an enlarged sectional view of part of the bottom of the spine shown in FIG. 1 with the lower cap slackened from the spine and the guide wire in a non-engaging position.

The bottom cap will now be described with reference to FIGS. 1 and 3. The bottom cap is generally U-shaped and has a front wall and a longer rear wall 70, 71 respectively defining a recess 72 which is adapted to fit over the bottom end of the spine with the wires and the covers positioned in the spine. The front wall 70 has an integral perpendicular lip 74 having an upper surface 75 for abutting the lower surface of portion 48 when in the assembled condition as shown in FIG. 4. As shown in FIG. 4 the cap has an aperture 76 for receiving a tamper-proof screw 78 which, even when unslackened, prevents the bottom cap from being removed from the spine because a punched indentation 80 in the bottom of the spine which engages with a shoulder portion 82 of the tamper-proof screw. The tamper-proof screw has an elongate unthreaded shank 83 between the shoulder portion and the threaded portion of such a length that when the screw is unscrewed and the cap removed from the spine, the shoulder engages the indentation such that there is clearance between the top of the rear wall 71 and the bottom of the spine to permit the cap to be rotated 90° to facilitate removal and replacement of covers as will be explained.

The center of the spine has an aperture 84 to which a hanger pin (not shown) similar to 64 may be secured to permit the telephone book holder to be suspended from the top cap 18 or the center pin.

FIGS. 4 and 5 show front and partly sectional side views respectively of an assembled book holder with covers 12, 14, wire 16 and top and bottom caps 18, 20 are secured to the spine. The position of a telephone book is shown by chain dotted lines.

The assembly of the telephone book holder will now be explained with reference to inserting a telephone book. It will be appreciated that the top and bottom caps are permanently secured in the factory by providing punched indentations after the tamper-proof screws are appropriately inserted through the caps. The cover edges 26 are firstly slid into selected channels 22 depending on the thickness of the telephone book to be accommodated and the end portions 44 of guide wires 16 are then located in the same channels. Because the edges 24 are cut away at the top (see FIG. 1) this provides the necessary clearance for the portions 44 to engage the slots 38 as shown at the top of FIG. 5. Once the covers and the top portions of the wires are inserted, the top cap is then positioned over the spine and fastened by the tamper-proof screw 55. Wires 16 are rotated relative to the top of the spine and secured by recesses 62 as seen at the top of FIG. 5 in dotted outline. The hooked rounded portions 46 permit the wire to rotate in the slot 38 and when portions 44 engage with recesses 62 the friction fit retains the wire in this position. The telephone book is then inserted in the book holder and opened to receive the guide wires. The guide wire then rotated downwardly towards the spine, and portions 48 are pressed over the ends of the spine so that the serrated portions 49 engages with the bases 51 of selected slots 38. In this position the wire is bowed toward the book and the resilience of the wire 16 causes the serrated portions to be retained in the slots 38. The telephone book is then secured by pushing the end cap onto the spine so that the recess 72 receives the end of the spine and the upper surface 75 of the lip 74 abuts with the undersurface of portions 48. The tamper-proof screw is then screwed in position to provide a secure fastening.

To replace or remove a telephone book is a straightforward operation. Firstly, the bottom tamper-proof screw 78 is unfastened and the end cap 20 pulled off the spine so that the top of the rear wall 71 clears the end of the spine. The wires 16 are rotated outwardly and secured in the recesses 62 and the telephone book removed. The book is secured in place by reversing the procedure. Also if one of the covers require to be replaced the retaining wires do not have to be removed at all. The procedure is similar when changing a cover except that when the bottom cap is slackened it is rotated through 90° to permit the front and rear covers to be slid off the spine. New covers can be inserted in the same way. For this procedure it will be appreciated that the bottom cap must be slackened off sufficiently so that the cover can be removed or inserted with sufficient ease. Similarly, covers can be replaced in different channels should the thickness of the book be changed for any reason.

Various modifications may be made to the embodiment as described without departing from the scope of the invention. For example, as shown in FIG. 5 the lower cap 20 may be fitted with a neoprene bumper 90 covering the base of the cap. The bumper prevents damage to the holder or a wall to which the holder is mounted where the holder and book are allowed to swing back about a horizontal board passing through the aperture 68. In addition, the spine member need not be made of aluminum and the covers need not be polyethylene or plastic. Furthermore, although there are six channels disclosed in the preferred embodiment, it will be understood that the invention is not limited to this number and in fact 2 channels, 4 channels or even 8 channels could be used. Also, the pinched indentation may be replaced by a plug inserted in an aperture in the spine, the plug being removable by a special tool to permit the end caps to be completely separated from the spine. Although the channels and the living hinges form a substantially watertight seal the covers may have formed wrap around edges to seal the top and bottom and front surfaces of the telephone book from the environment, this being particularly suitable for open telephone kiosks.

Also, it should be understood that only one cap could be used and that the channels need not extend over the whole length of the spine as long as the covers can be slid on and off one end. The top cap could also be removable and the retaining wires pivoted about the bottom of the spine. In this case, covers could be inserted or removed from the top of the spine.

We claim:

1. A book holder for telephone books and the like comprising, a book holder spine having a front surface and a rear surface and a top end and a bottom end, a longitudinal book holder spine axis having a plurality of substantially parallel channels located in the rear surface and said plurality of channels comprising at least one channel located on either side of a longitudinal centreline midway across said rear surface and said channels extending parallel to the longitudinal book holder spine axis from one of said top and bottom ends of the book holder spine substantially to the other of said top and bottom ends of the book holder spine, each channel defined by spaced parallel walls and a base, and said spaced walls having top wall portions defining a respective channel opening on the rear surface of said book holder spine, said spaced parallel walls being so profiled that said respective channel opening is narrower than the distance between said spaced parallel walls, a front cover and a rear cover, each cover consisting of a respective integral edge portion each respective edge portion being slidably received in a respective channel, a respective rear and front cover portion integrally connected to each respective edge portion by a respective crease in said respective front and rear cover, a respective front and rear cover flaps integrally connected to said respective front and rear cover portions by at least one living hinge, each said at least one living hinge permitting each respective front and rear cover flaps to be rotated between an open and a closed position, book retaining means extending between the top and bottom ends of the book holder spine for retaining a book in the book holder, and first cap means detachably secured to said one end of the book holder spine for securing the book retaining means and the front and rears covers to the book spine, said first cap means being detachable to permit front and rear said covers to be engaged and disengaged with the book holder spine by sliding said edge portions relative to said channels each respective edge portion having a width greater than said respective channel opening so that said edge portion is prevented from being removed from the spine other than by sliding movement parallel to the longitudinal book holder spine axis.

2. A book holder as claimed in claim 1 wherein said plurality of substantially parallel channels extend from the top end of the book holder spine to the bottom end of the book holder spine and said first cap means is provided at the bottom end of the book holder spine and second cap means are provided at the top end of the book holder spine, said second cap means being detachably secured to the book book spine and defining with the book holder spine a pivotal connection to permit the book retaining means to be pivoted about said pivotal connection outwardly from the book holder spine to an outward position, said second cap means having holding means for holding said book retaining means at said outward position to facilitate entry and removal of a book.

3. A book holder as claimed in claim 1 wherein said plurality of channels comprises pairs of channels with channels of respective pairs being symmetrically positioned about said longitudinal centerline located midway across the rear surface of the book holder spine, and the respective integrally formed edge portions of said front and rear covers being locatable in selected channels located on different sides of said longitudinal centerline to vary the distance between said front and rear covers to accommodate books of different thickness.

4. A book holder as claimed in claim 3 wherein the first cap means includes book holder suspension means, the book holder suspension means being securable to support means, said book holder suspension means including a swivel connection for permitting the book holder to accommodate torsional forces applied thereto.

5. A book holder as claimed in claim 3 wherein the rear surface of the book holder spine includes book holder suspension means spaced along its length, said book holder suspension means including a swivel connection for permitting the book holder to accommodate torsional forces applied thereto.

6. A book holder as claimed in claim 2 wherein the first and second cap means are fastened to said respective top and bottom ends of the book holder spine by tamper-proof screws.

7. A book holder as claimed in claim 1 wherein said book retaining means is at least one wire, said at least one wire having a top wire end and a bottom wire end for being coupled to a respective top and bottom ends of the spine, each of said top and bottom ends of the book holder spine having at least one respective top and bottom slot extending parallel to the longitudinal book holder spine axis, the first cap means defining a generally U-shaped recess in which the top end of the book holder spine, top end of the wire and top ends of the front and rear book covers can be accommodated, said first cap means including an outwardly extending lip adapted to be located on the front surface of the book holder spine, said outwardly extending lip having a lip slot aligned with said at least one top slot, said lip slot tapering towards a base region having a smaller width than the wire, said top wire end having a hooked portion which is proportioned to fit in said top slot, and said bottom wire and having a serrated portion propotioned to fit in said bottom slot, the distance between the top and bottom slots being slightly greater than the distance between the hooked portion and the serrated portion of the wire, and when said first cap means is slackened from said book holder spine, said wire is pivotable about the top slot so that the wire frictionally engages at said base region so that the wire is arranged substantially perpendicular to the plane of a book's spine supported therein, and said serrated portion being adapted to frictionally engage said bottom slot resulting in strain on the wire which causes the wire to bow towards the front surface of the spine to secure a book in position as the seciond cap means is being fastened to the book holder spine.

8. A book holder as claimed in claim 1, wherein there are six parallel channels provided in the rear surface, two groups of three channels being symmetrically located on each side of a longitudinal centerline located midway across the rear surface of the book holder spine, each channel communicating at the top end and bottom end of the book holder spine with a respective top and bottom slot extending through the book spine, each respective top and bottom slot bein dimensioned and to receive respective top and bottom ends of the book retaining means.

9. A book holder as claimed in claim 6, wherein the book spine has a punched indentation on its surface at a level opposite a guide for the bottom tamper-proof screw, the tamper-proof screw having a shoulder portion wider than the guide at the level of the punched indentation, so that the shoulder portion engages said punched indentation after being unfastened and prevents the tamper-proof screw and second cap from being removed from the book holder spine.

10. A book holder as claimed in claim 1, wherein said parallel channels are generally U-shaped and are defined by wall means having at least one projection parallel to said channel for engaging the respective rear surface of said internal edge portion, said wall means and said projection defining a width of the channel adjacent the projection narrower than the width of the edge portion to prevent the edge portion from being removed from the book spine other than by sliding movement parallel to the spine.

11. A book holder as claimed in claim 7 wherein six parallel channels are provided in the rear surface of the book spine, said six parallel channels being arranged in two groups of three channels symmetrically located on each side of the longitudinal centerline located midway across the rear surface of the book spine, each channel communicating at the top and bottom end of the book spine with a respective top and bottom slot extending through said book spine, each respective top and bottom slot being dimensioned and proportioned to accomodate top and bottom ends of the book retaining means.

12. A book holder comprising a generally elongate book spine of rectangular cross-section, said book spine having a front surface and a rear surface and top and bottom ends, said rear surface having a plurality of parallel channels provided in the rear surface of the book spine, said a plurality of parallel channels being arranged in two groups of equal numbers of channels symmetrically located on each side of a longitudinal centerline located midway across the surface of the book spine, each channel communicating at the top and bottom end of the book spine with a respective top and bottom slot extending through said book spine, each channel being generally U-shaped and are defined by wall means having at least one projection parallel to said channel, a front book cover and a rear book cover, each of said front and rear covers having an integrally formed respective edge portion, each respective edge being slidably inserted in a respective channel, a respective rear cover portion integrally connected to each respective edge portion by a respective crease in said cover, a respective front and rear cover flap integrally connected to each respective rear cover portion by at least one living hinge, said at least one living hinge permitting each respective front and rear cover flap to be rotated between an open and a closed position, said wall means and projection defining a width of the channel in the region of the projection narrower than a width of the edge portion to prevent the edge portion from being removed from the book spine other than by sliding movement parallel to the spine, a pluraity of book retaining wires each having a top and bottom end extending between the respective top and bottom ends of the book spine, each book retaining wire top end having a hooked portion which is proportioned to fit in a respective top slot, said bottom wire end having a serrated portion proportioned to fit in a respective bottom slot, the distance between the top and bottom slots being slightly greater than the distance between the hooked portion and the serrated portion of the wire, top cap means detachably secured to the top of the book spine for securing said top ends of the book retaining wires and said front and rear covers to the book spine, said top cap means including an outwardly extending lip located on the front surface of the book spine and said outwardly extending lip having a plurality of lip slots each aligned with a respective said top slot, each lip slot having a slot opening tapering towards a base region of a smaller width than the wire, and bottom cap means detachably secured to the bottom end of the book spine, said bottom cap means being loosenable from the bottom end of the book spine so that said book retaining wires can be pivoted about said top end so that said wires frictionally engage in a respective lip slot at said base region so that the wires are arranged substantially perpendicular to the book spine front surface and a book can be inserted into said book holder, and said serrated portions being frictionally engaged in said respective bottom slots which result in said respective wires being strained and caused to bend towards the front surface of the book spine, said bent wires being resilient so that when a book is positioned in the book holder the resilience and shape of the wires securely fastens the book to the book holder, and said top and bottom cap means being detachable and rotatable relative to the book spine whereby front and rear book covers can be removed and replaced in any of said plurality of channels without completely separating the top and bottom cap means from the book spine.

13. A book holder as claimed in claim 12 wherein six parallel channels are provided in the rear surface of the book spine, said six parallel channels being arranged in two groups of three channels symmetrically located on each side of the longitudinal centerline located midway across the rear surface of the book spine.

14. A book holder as claimed in claim 12 wherein two book retaining wires are provided for each book.

15. A book holder as claimed in claim 12 wherein the rear surface of the book spine includes book holder suspension means spaced along its length, said suspension means including a swivel connection for permitting the book holder to accommodate torsional forces applied thereto.

16. A book holder as claimed in claim 12 wherein the top cap means and bottom cap means are fastened to said respective top and bottom ends of the book spine by tamper-proof screws.

17. A book holder as claimed in claim 2 wherein the top cap means includes book holder suspension means, the book holder suspension means being securable to support means, said suspension means including a swivel connection for permitting the book holder to accommodate torsional forces applied thereto.

18. A book holder as claimed in claim 2 wherein said book retaining means is a wire having a top wire end and a bottom wire end for being coupled to a respective top and bottom ends of the spine, each of said top and bottom ends of the book spine having at least one respective top and bottom slot extending parallel to the longitudinal book spine axis, the first cap defining a generally U-shaped recess in which the top end of the book spine, top end of the wire and top ends of the front and rear book covers can be accommodated, said first cap means including an outwardly extending lip adapted to be located on the front surface of the book spine, said outwardly extending lip having a lip slot aligned with said at least one top slot, said lip slot having a slot opening tapering towards a base region of a smaller width than the wire, said top wire end having a hooked portion which is proportioned to fit in said top slot, and said bottom wire and having a serrated portion proportioned to fit in said bottom slot, the distance between the top and bottom slots being slightly greater than the distance between the hooked portion and the serrated portion of the wire, and when said first cap means is slackened from said book spine, said wire is pivotable about the top slot so that the wire frictionally engages at said base region so that the wire is arranged substantially perpendicular to the plane of the paper, and a book can be inserted in said book holder, and said serrated portion being adapted to frictionally engage said bottom slot resulting in strain on the wire which causes the wire to bow towards the front face of the spine to secure a book in position as the second cap means is being fastened to the book spine.

19. A book holder as claimed in claim 7, wherein said parallel channels being generally U-shaped and are defined by wall means having at least one projection parallel to said channel for engaging the respective rear surface of said integrally formed edges, said wall means and projection defining a width of the channel in the region of the projection narrower than the width of the edge portion to prevent the edge portion from being removed from the book spine other than by sliding movement parallel to the spine.

* * * * *

UNITED STATES PATENT AND TRADEMARK OFFICE

CERTIFICATE OF CORRECTION

PATENT NO. : 4,561,623

DATED : December 31, 1985

INVENTOR(S) : Charles G. Shepherd et al

It is certified that error appears in the above-identified patent and that said Letters Patent is hereby corrected as shown below:

Title page, item [21] Appl. No.: "809,370" should read --609,370--.

Signed and Sealed this

Seventeenth Day of April, 1990

*Attest:*

HARRY F. MANBECK, JR.

*Attesting Officer*

*Commissioner of Patents and Trademarks*